US006687950B1

(12) United States Patent
Rata et al.

(10) Patent No.: US 6,687,950 B1
(45) Date of Patent: Feb. 10, 2004

(54) DOCTOR BLADE AND BLADE HOLDER COMPRISING COMPOSITE MATERIAL AND CERAMIC COATING

(75) Inventors: Ilkka Rata, Jyväskylä (FI); Kari Niemi, Tikkakoski (FI); Heikki Toivanen, Jyväskylä (FI); Timo Lintula, Keuruu (FI); Ilkka Eskelinen, Varkaus (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/719,401

(22) PCT Filed: May 27, 1999

(86) PCT No.: PCT/FI99/00459

§ 371 (c)(1),
(2), (4) Date: Dec. 8, 2000

(87) PCT Pub. No.: WO99/64674

PCT Pub. Date: Dec. 16, 1999

(30) Foreign Application Priority Data

Jun. 9, 1998 (FI) ..... 981312

(51) Int. Cl.[7] ..... G03G 21/00; B21B 45/02; D21G 3/00; B31F 1/14

(52) U.S. Cl. ..... 15/256.51; 162/281; 399/350

(58) Field of Search ..... 15/256.51; 118/123, 118/126, 261, 413; 399/350, 355; 162/280, 281

(56) References Cited

U.S. PATENT DOCUMENTS

| | | | | |
|---|---|---|---|---|
| 3,703,019 A | * | 11/1972 | Bratt | 15/256.51 |
| 4,549,933 A | | 10/1985 | Judd et al. | 162/281 |
| 4,735,144 A | * | 4/1988 | Jenkins | 101/464 |
| 5,408,720 A | | 4/1995 | Miles | 15/256.51 |
| 5,727,468 A | | 3/1998 | Blackwell | 101/365 |
| 5,824,154 A | * | 10/1998 | Freti | 118/126 |
| 6,207,021 B1 | * | 3/2001 | Eriksson et al. | 162/281 |

FOREIGN PATENT DOCUMENTS

| | | |
|---|---|---|
| DE | 19743210 | 4/1998 |
| EP | 0262137 | 5/1990 |
| FI | 875167 | 12/1990 |
| FI | 101636 | 7/1998 |
| GB | 2130924 | 10/1983 |
| JP | 54149787 | 5/1978 |
| JP | 4070341 | 3/1992 |
| JP | 5338048 | 12/1993 |
| SE | 437681 | 3/1985 |
| WO | 9912726 | 3/1999 |

* cited by examiner

*Primary Examiner*—Robert J. Warden, Sr.
*Assistant Examiner*—Laura C Cole
(74) *Attorney, Agent, or Firm*—Steinberg & Raskin, P.C.

(57) ABSTRACT

The invention relates to an apparatus comprising a holder (2) for a doctor blade and a blade (1) to be fitted in the holder for use in a paper or board machine. The holder (2) and/or the blade (1) comprises a composite material of whose surface or on a part of whose surface a ceramic coating (6) has been made.

17 Claims, 1 Drawing Sheet

DOCTOR BLADE AND BLADE HOLDER COMPRISING COMPOSITE MATERIAL AND CERAMIC COATING

FIELD OF THE INVENTION

Figure 1:
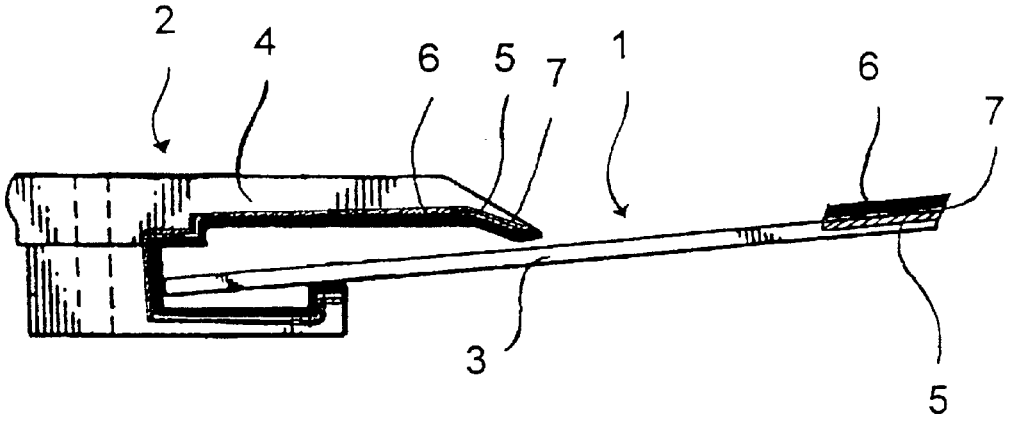

The invention relates to an apparatus comprising a holder for a doctor blade and a doctor blade to be fitted in the holder for use in a paper or board machine.

BACKGROUND OF THE INVENTION

Doctors are used for removing impurities formed on the surface of rolls in paper, board and finishing machines. The doctor is composed of a doctor blade which comes into contact with the roll surface detaching impurities etc, and of a blade holder to which the blade is attached. The holder is in turn attached to a doctor beam arranged on the frame of the machine. In connection with doctoring, air, water and/or chemical jets can be used for enhancing the cleaning process.

The doctor blade is most commonly made of metal. Metal blades suffer from the drawbacks that the roll surface is being coated with doctor metal and the roll surfaces are easily damaged. It is undesirable that the roll surface is being coated with metal because a change in the surface properties of the roll has an unpredictable effect on runnability. For reasons of runnability, even slight damage to the roll surfaces, for example, scratching, is a serious drawback. Metal blades have great problems in doctoring polymeric roll surfaces in particular. In order to overcome these problems, metal blades have been coated with different materials, among other things, with a ceramic. As examples of coated metal blades may be mentioned EP 0 262 137, in which a doctor blade made of carbon steel is coated with molybdenum or a molybdenum alloy by flame spraying, and SE 437 681, in which a doctor blade made of steel is coated with several ceramic coating layers using a plasma or flame spraying method.

In recent years, in addition to metal blades, increasing use has been made of doctor blades manufactured a of fibre-reinforced polymeric material. Such so-called composite blades are disclosed, for example, in U.S. Pat. No. 4,549,933 and in FI patent applications 972776 and 973659. Composite blades have several advantages over metal blades, among other things, light weight, price, freedom of shaping, and gentleness to the roll coating. On the other hand, composite blades wear more quickly than metal blades and leave polymeric material on the roll surface. It has not been possible to coat composite blades with a ceramic or with an equivalent more wear-resistant material because ceramic material does not adhere to a polymeric surface and, on the other hand, polymeric material does not withstand spray coating taking place at high temperature.

Conventionally, the holder of the doctor blade has also been manufactured of steel. Holders have also been made of plastic and of composite materials, but there have been problems in their abrasion resistance. Doctor blades are attached to holders by means of metal rivets or other equivalent members. The blades are replaced frequently, and the metal rivets rub against and wear the holder heavily. In particular, the scratching of the inner surface presents a problem because the scratched surface makes it difficult to fit a new blade in place and, when carbon fibre blades are used, the risk of the blade being damaged because of the scratching of the holder is also obvious.

OBJECTS AND SUMMARY OF THE INVENTION

The object of the invention is to provide a doctor blade and a blade holder as well as an apparatus which are lighter in weight, more resistant to wear and more advantageous.

Characteristic features of the apparatus, doctor blade and blade holder according to the invention are stated in the claims.

It was found that the problems and disadvantages of prior-art arrangements can be avoided by the arrangement according to the invention in which the doctor blade and/or the blade holder is/are made of a composite material on which a ceramic coating has been formed. A composite blade does not scratch the surface of the roll, in contrast to a blade which is coated, for instance, with a ceramic or carbide and whose coating has worn off exposing metal. The composite material may be a fibre-reinforced thermosetting or thermoplastic resin. The ceramic coating can be formed and caused to hold on the composite structure such that the composite structure is provided with an anchor structure of a metal wire, wire mesh, metal foil, a metal powder or equivalent, which anchor structure enables the ceramic to be fixed to the surface of the composite or below the surface if the anchor structure is below the surface. The anchor structure may be on the surface of the composite, partly in the composite structure or totally embedded in the composite structure very close to the surface. The ceramic coating is formed onto the surface of the composite by means of thermal spraying at a temperature that is below 150° C., at which the composite does not substantially melt nor is otherwise damaged. There are no limitations on the shaping of the blades or blade holders made of a composite material. The doctor blade and the holder in accordance with the invention can be manufactured of a thermosetting or thermoplastic resin reinforced with fibreglass or carbon fibre, with boron fibre and generally with a fibre composite or their combination. Carbon fibre is particularly preferable since its thermal conductivity is very close to the thermal conductivity of metals. A metal wire, a metal strip, wire mesh, metal foil, a metal powder, combinations of metal and plastic, or a plastic-ceramic powder is/are fixed to the surface of the composite or embedded in the composite. Suitable methods of manufacturing composite blades and holders are casting, compression moulding, pultrusion and extrusion methods and combinations of different methods. The selection of the method is also affected by the orientation of desired fibre directions. The pultrusion method is the most preferable method for its good production rate. On the doctor blade or the blade holder made of a composite material, a ceramic coating is made by means of thermal spraying or by means of electrolytic methods, such as brush electroplating, or by means of autocatalytic methods, such as chemical nickel plating, where ceramic is in dispersion. All conventional ceramics are suitable ceramic materials. However, preferable materials are those which can be readily sprayed, which are low-priced and chemically durable, such as $Al_2O_3$ and $Cr_2O_3$. The doctor blade may be provided with a ceramic coating either over the entire surface area or only over the wear area depending on where the blade is used. Preferably, one third of the width of the blade is coated. The coating of the doctor blade or the blade holder can be performed with the same ceramic or with a combination of different ceramics, and one or more ceramic layers can be made one above the other. If the composite sections are not completely coated with a ceramic coating, possible wetting of the composite material may be prevented by providing a protective coating on the surface of the composite, for example, electrolytically. The apparatus according to the invention comprising a doctor blade and a holder for the doctor blade can be used in paper and board machine lines, which also include printing machines and coating machines. Optionally, only either the blade or the holder is made of a composite material coated with a ceramic and the other of them is made of metal or another suitable material.

In the following, the invention is illustrated by way of example by means of one advantageous embodiment of the invention, to the details of which the invention is, however, not intended to be confined.

DETAILED DESCRIPTION OF THE INVENTION

FIG. 1 is a schematic view of a doctor blade and a holder for the doctor blade. The doctor blade 1 is fitted in the doctor blade holder 2. A core part 3 of the doctor blade 1 comprises a composite material whose surface layer is provided with an anchor layer 5 on which a ceramic layer 6 has been made. A core part 4 of the blade holder 2 comprises a composite material to whose surface layer an anchor layer 5 is fixed, a ceramic layer 6 being formed on said anchor layer. Before preparing the ceramic coating, different intermediate layers 7 may be used for equalizing the heat generated in the spraying of ceramic and for reducing the risk of the composite being damaged. The intermediate layers may be of metal, for example, aluminium and nickel-based materials, advantageously of a sprayed metal. In this arrangement, the blade is coated only in the wear area and the holder on its inside which comes into contact with the blade. The blade is preferably coated at its front side, so that sharpening of the blade and its keeping sharp are accomplished in the best way.

The advantages of the doctor blade and the blade holder in accordance with the invention include good chemical durability of the apparatus, the composite blade can be readily mounted in the holder and treatment is easy. Both the blade and the holder are light in weight and they are easy to machine. Both withstand wear and scratching well and thus their service life is longer than that of previous arrangements. The doctor blade holder manufactured of a composite is very light in weight. With increasing machine speeds, even in difficult locations, because of lack of space, it has been necessary to apply supercritical dimensions in connection with doctor beams of prior art arrangements, which causes that the doctor beam is less rigid. Because of the smaller rigidity of the beam, it is beneficial to reduce the weight of the holder because the reduction of the weight of the holder contributes to decreasing the deflection of the beam. The price of the blade holder made of a composite material is competitive since the manufacturing costs of the holder are lower and, on the other hand, the operating costs of the blades are lower for the reason that the blades need not be replaced so frequently. Further, these blades wear rolls to a considerably smaller extent because they do not scratch the surface. With respect to dimensions, the apparatus has a greater rigidity and a low weight with the result that less loading energy is needed, excluding the load based on gravity. The low weight of the holder facilitates mounting and displacement.

What is claimed is:

1. An apparatus comprising:

a holder for a doctor blade;

a blade structured and arranged to be held by said holder;

wherein each of said blade and said blade holder are constructed from a composite material and wherein a surface of said holder and a surface of said blade each have a ceramic coating applied thereon;

wherein said composite material is one of a fiber reinforced thermosetting and fiber reinforced thermoplastic resin; and further wherein each of said holder and said blade further comprise an anchor layer interposed between said composite material and said ceramic coating.

2. The apparatus according to claim 1, wherein said fiber is selected from the group consisting of carbon fiber, glass fiber and boron fiber.

3. The apparatus according to claim 1, wherein said anchor layer is selected from the group consisting of metal wire, wire mesh, a metal strip, metal foil, a metal powder, combinations of metal and plastic, a plastic-ceramic powder, a ceramic powder.

4. The apparatus according to claim 1, wherein each of said holder and said blade further comprises at least one intermediate layer arranged between said anchor layer and said ceramic coating.

5. The apparatus according to claim 4, wherein said intermediate layer is a metal material.

6. The apparatus according to claim 5, wherein said metal material is one of a Al and Ni based metal.

7. The apparatus according to claim 1, wherein the ceramic coating is selected from the group consisting of $Al_2O_3$, $Cr_2O_3$, $TiO_2$, $ZrO_2$ or combinations thereof.

8. A blade holder comprising:

a blade holder body constructed from a composite material, said blade holder body having a surface;

a ceramic coating arranged on said blade holder body surface;

wherein the ceramic coating: is selected from the group consisting of $Al_2O_3$, $Cr_2O_3$, $TiO_2$, $ZrO_2$ or combinations thereof and said blade holder further comprises an intermediate layer arranged between said composite material and said ceramic coating.

9. The blade holder according to claim 8, wherein said composite material is one of a fiber reinforced thermosetting and fiber reinforced thermoplastic resin.

10. The blade holder according to claim 9, wherein said fiber is selected from the group consisting of carbon fiber, glass fiber and boron fiber.

11. The blade holder according to claim 8, wherein said intermediate layer is a metal material.

12. The blade holder according to claim 8, wherein said blade holder includes an inside portion and said inside portion is coated with a ceramic material.

13. An apparatus comprising:

a holder for a doctor blade;

a blade structured and arranged to be held by said holder;

wherein each of said blade and said blade holder are constructed from a composite material and wherein a surface of said holder and a surface of said blade each have a ceramic coating applied thereon;

wherein each of said holder and said blade further comprise an anchor layer interposed between said composite material and said ceramic coating.

14. The apparatus according to claim 13, wherein said anchor layer is selected from the group consisting of metal wire, wire mesh, a metal strip, metal foil, a metal powder, combinations of metal and plastic, a plastic-ceramic powder, a ceramic powder.

15. The apparatus according to claim 13, wherein each of said holder and said blade further comprises at least one intermediate layer arranged between said anchor layer and said ceramic coating.

16. The apparatus according to claim 15, wherein said intermediate layer is a metal material.

17. The apparatus according to claim 16, wherein said metal material is one of a Al and Ni based metal.

* * * * *